US007243795B2

(12) United States Patent
Gold et al.

(10) Patent No.: US 7,243,795 B2
(45) Date of Patent: Jul. 17, 2007

(54) IDENTIFICATION SYSTEM FOR INDIVIDUAL CONTAINERS

(76) Inventors: Robert Gold, 2105 Far Gallant, Austin, TX (US) 78746; Stephen Cochran, 439 Wycoff Ave., Wyckoff, NJ (US) 07481

( * ) Notice: Subject to any disclaimer, the term of this patent is extended or adjusted under 35 U.S.C. 154(b) by 527 days.

(21) Appl. No.: 10/812,435

(22) Filed: Mar. 30, 2004

(65) Prior Publication Data

US 2005/0218026 A1 Oct. 6, 2005

(51) Int. Cl.
*B65D 77/00* (2006.01)

(52) U.S. Cl. ..... 206/459.5; 206/459.1; 40/306; 40/310

(58) Field of Classification Search ..... 283/72, 283/74, 81, 100, 117, 901; 40/310, 306; 206/459.1, 217, 459.5, 232; 215/365, 230
See application file for complete search history.

(56) References Cited

U.S. PATENT DOCUMENTS 3,574,957 A * 4/1971 Bello-Bridick ..... 434/173
4,752,087 A * 6/1988 Weisbach ..... 283/67
RE33,979 E * 6/1992 Cortopassi ..... 206/459.1
5,191,979 A * 3/1993 Nemeroff ..... 206/459.5
5,301,802 A * 4/1994 Nemeroff ..... 206/217
6,508,361 B2 * 1/2003 Shrader ..... 206/459.1
6,868,627 B2 * 3/2005 Elias ..... 40/306
2004/0060840 A1 * 4/2004 Williams et al. ..... 206/459.5

* cited by examiner

*Primary Examiner*—David T. Fidei
(74) *Attorney, Agent, or Firm*—Adams & Wilks

(57) ABSTRACT

An identification system distinguishes among a set of individual containers. The identification system has an identifier member associated with each of the containers in the set for facilitating visual discrimination of each of the containers from the others of the set. The identifier member of each container in the set has distinct and visibly different printed identifying indicia positioned over a surface portion of the container, and an opaque covering material covering the printed identifying indicia. The opaque covering material is removable to selectively expose a preselected one of the printed identifying indicia so that during consumption of the contents of the container a user may readily distinguish his container from the other containers in the set by visual inspection of the exposed printed identifying indicia.

29 Claims, 6 Drawing Sheets

70

72

74

76

IDENTIFICATION SYSTEM FOR INDIVIDUAL CONTAINERS

BACKGROUND OF THE INVENTION

1. Field of the Invention

The present invention relates generally to identification systems and, more particularly, to an identification system for distinguishing among individual containers, such as individual drinking containers or individual containers of a consumer package of products.

2. Background Information

Containers of products for consumer use, such as food and beverage containers, have been packaged in sets having four, six or even more containers. Usually, each container is identical to the others of the set with each container displaying thereon identical indicia over a major portion of the container. This indicia not only serves to convey information about the contents of the container, but it also depicts manufacturer and distributor trade information as well as trademark and trade dress configurations, colorations and words. Since each container in a set is virtually identical to the others, distinguishing between each container is almost impossible once the containers are separated from the original packaging arrangement.

Often, at a party or other social setting, mistakes of container identity occur where individuals mistakenly drink or eat from containers which previously had been used by another. For example, many times an individual sets his beverage container down momentarily and returns to it later. Sometimes, that person either becomes unsure where the beverage container was placed, or finds that two or more similar appearing beverage containers have been left in the same area making it difficult to determine which beverage belongs to whom. In general, it is impolite to drink from another person's beverage container, and such often results in squabbles about whose beverage container belongs to whom. Additionally, picking-up and drinking another person's beverage can pose a risk of exposure to any contagious medical condition that the other person may have. In this regard, modern medicine and most informed people generally recognize the desirability of not drinking or eating from another person's beverage or food container. This is particularly important because of the widespread presence of germs and other contagion, including AIDS, Hepatitis A, B, C, G and the like, cold sores (Herpes), and flu viruses. Thus, without means for identifying individual containers taken from a consumer pack, social occasions and even family gatherings can be dampened by the nagging fear of whether the opened consumer food or beverage container just picked up and eaten or drunk from was the same one just recently laid down.

Moreover, disposable drinking cups are extremely popular for the convenience they offer in situations in which large numbers of people are served. As is well known, disposable cups are offered by manufacturers in plastic or paper, and are available in plain, unadorned form, in colors, or with decorative designs. Disposable cups are typically purchased in bulk, and in the usual case, all of the cups in a given package are similar, if not identical, in appearance. Again, this leads to the situation in which the drinks of individual users, when put down momentarily, cannot be distinguished from one another. Thus, individuals often cannot identify their own drinks and are faced with the choice of drinking from a cup which may have been used by another, or abandoning what may indeed be their own drink. When such confusion of one drink for another occurs, the results are unsanitary and potentially injurious to health. On the other hand, when one unnecessarily abandons a cup because it cannot positively be identified, the result is wasteful and uneconomical.

Although some prior patents have discussed ways for identifying containers of food and beverage products, it is believed they are limited by either their complexity and expense, or their appearance and impracticality. For example, in U.S. Pat. No. 3,908,877 granted to Kosisky, it was proposed to provide a circular tray having circumferentially spaced openings marked with the names of individual users. Cups, also bearing the names of the individual users, are associated with the openings. Such an arrangement permits the identification of cups and drinks, but in order for the disclosed technique to work, the cups must be returned to the tray. U.S. Pat. No. 3,354,564 to Falcone et al. and U.S. Pat. No. 2,976,629 to Brixius et al. disclose identification insignia hanging or secured onto a container by pressure clips or other means. This approach is burdensome and detracts from the overall trade dress of the container. Likewise, using large, non-similar labels to identify different containers not only deemphasizes the manufacturer's and distributor's trademark and trade dress but it also obscures the important container content and labeling information usually mandated by governmental regulations.

Other types of personal identification of food and beverage containers have been proposed, illustrative of which are the proposals of U.S. Pat. No. 2,024,889 granted to A. Simeone; U.S. Pat. No. 3,392,468 granted to David Wolf; U.S. Pat. No. 3,974,916 granted to Edgar O. Artolucci; U.S. Pat. No. 4,203,240 granted to George I. Goodwin; U.S. Pat. No. 4,347,804 granted to Antony-Euclid C. Villa-Real; U.S. Pat. No. 4,759,139 granted to M. David Ricks; U.S. Pat. No. 4,901,457 granted to Donald O. Chandler; U.S. Pat. No. 5,492,077 granted to Howard L. Rose; U.S. Pat. No. 5,799,815 granted to Micheal A. Lang; U.S. Pat. No. 5,839,581 granted to Douglas Vagedes; and U.S. Pat. No. 5,845,777 granted to Boman K. Najmi. Although such proposals have addressed selected problems encountered in providing personal identification for containers of alimentary products (e.g., food and beverages), there have continued to be certain drawbacks to their use. Thus, for a variety of reasons such as cost or cumbersomeness in use, they have not found popular expression in the marketplace.

Accordingly, there has continued to be a need for improved identification devices and systems for food and beverage containers that are simple, inexpensive, and easy to use and prevent inadvertent drinking or eating from the wrong container, particularly where a number of individuals are using containers having the same general appearance.

SUMMARY OF THE INVENTION

It is, therefore, an object of the present invention to provide an identification system for distinguishing among individual containers of a consumer package of products, such as food and beverage products.

It is another object of the present invention to provide an identification system for distinguishing among individual drinking containers, such as drinking cups.

It is another object of the present invention to provide an identification system for distinguishing among individual containers which prevents the inadvertent eating or drinking from the wrong container, particularly where a number of individuals are using containers having the same general appearance.

It is a further object of the present invention to provide an identification system for distinguishing among individual containers which is simple, easy to use, and cost effective.

It is another object of the present invention to provide an identification system for distinguishing among individual containers and which does not distract from the manufacturer's or distributor's trade dress, trademark or container labeling information.

It is another object of the present invention to provide an identification system for distinguishing among individual containers and which protects the consumer of the products from the risk of exposure to any contagious medical condition that other consumers may have.

It is yet another object of the present invention to provide an identification system for distinguishing among individual containers and which will prevent squabbles between relatives and friends about whose container is whose.

The foregoing and other objects of the present invention are carried out by an identification system for distinguishing among individual containers each visually substantially identical in size and shape to one another. The identification system has an identifier member associated with each of the containers in the set for facilitating visual discrimination of each of the containers from the others of the set. The identifier member of each container in the set comprises distinct and visibly different printed identifying indicia positioned over a surface portion of the container, and an opaque covering material covering the printed identifying indicia. The opaque covering material is removable to selectively expose a preselected one of the printed identifying indicia so that during consumption of the contents of the container a consumer may readily distinguish his container from the other containers in the set by visual inspection of the exposed printed identifying indicia.

Preferably, the opaque covering material comprises a coating of scratch-off non-transparent material that conceals the printed identifying indicia until the coating is scratched off to expose the preselected printed identifying indicia. In one embodiment, the opaque covering material of the identifier member has visible discrete areas each covering a respective one of the printed identifying indicia. The content in each of the containers in the set preferably comprises an alimentary product, such as a beverage or a food product.

In another embodiment, the identifier member comprises a substrate layer having a first main surface on which the printed identifying indicia is printed and over which the opaque covering material is disposed to cover the printed identifying indicia, and an adhesive layer disposed on a second main surface of the substrate layer opposite the first main surface for adhering the substrate layer to the surface portion of the container. Additionally, a removable backing layer may be disposed over the adhesive layer for protecting the adhesive layer prior to adhering the substrate layer to the surface portion of the container.

According to another embodiment of the present invention, an identification system is provided for distinguishing among individual containers of a consumer package of products each visually substantially identical in size and shape to one another. An identifier member is associated with each of the containers in the set for facilitating visual discrimination of each of the containers from the others of the set. The identifier member of each container in the set comprises distinct and visibly different printed identifying indicia positioned over a first surface portion of the container, and an opaque covering material disposed over a second surface portion of the container different from the first surface portion thereof and having a preselected color. The opaque covering material has a color which contrasts with the preselected color of the second surface portion of the container and has a plurality of visible discrete areas each corresponding to a respective one of the printed identifying indicia. Each of the visible discrete areas of the opaque covering material is selectively removable to expose the preselected color of the second surface portion of the container so that during consumption of the contents of the container a consumer may readily distinguish his container from the other containers in the set by visual inspection of the exposed preselected color of the second surface of the container corresponding to the removed discrete area of the opaque covering material and by visual inspection of the printed identifying indicia corresponding to the removed discrete area of the opaque covering material.

In another aspect, the present invention comprises an identification system in combination with a plurality of groups of separate containers, all of the containers within all of the groups being substantially visually identical in size and shape to each other. The identification system has an identifier member associated with each of the containers in each of the groups for facilitating visual discrimination of each of the containers within any group from one another and from the containers of other groups. The identifier member associated with each of the containers within all of the groups comprises a set of distinct and visibly different printed identifying indicia positioned over a surface portion of the container, and an opaque covering material covering the set of printed identifying indicia. All of the sets of printed identifying indicia within any group of containers are substantially visually identical to one another, and the sets of printed identifying indicia of each group of containers are visually distinct from the sets of printed identifying indicia of other groups of containers. The opaque covering material of the identifier member associated with each of the containers of the sets within all of the groups is removable to selectively expose a preselected one of the printed identifying indicia so that during consumption of the contents of the container a consumer may readily distinguish his container from the other containers within any group and from the containers of other groups by visual inspection of the exposed printed identifying indicia.

BRIEF DESCRIPTION OF THE DRAWINGS

The foregoing summary, as well as the following detailed description of preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENTS

Figure 2:
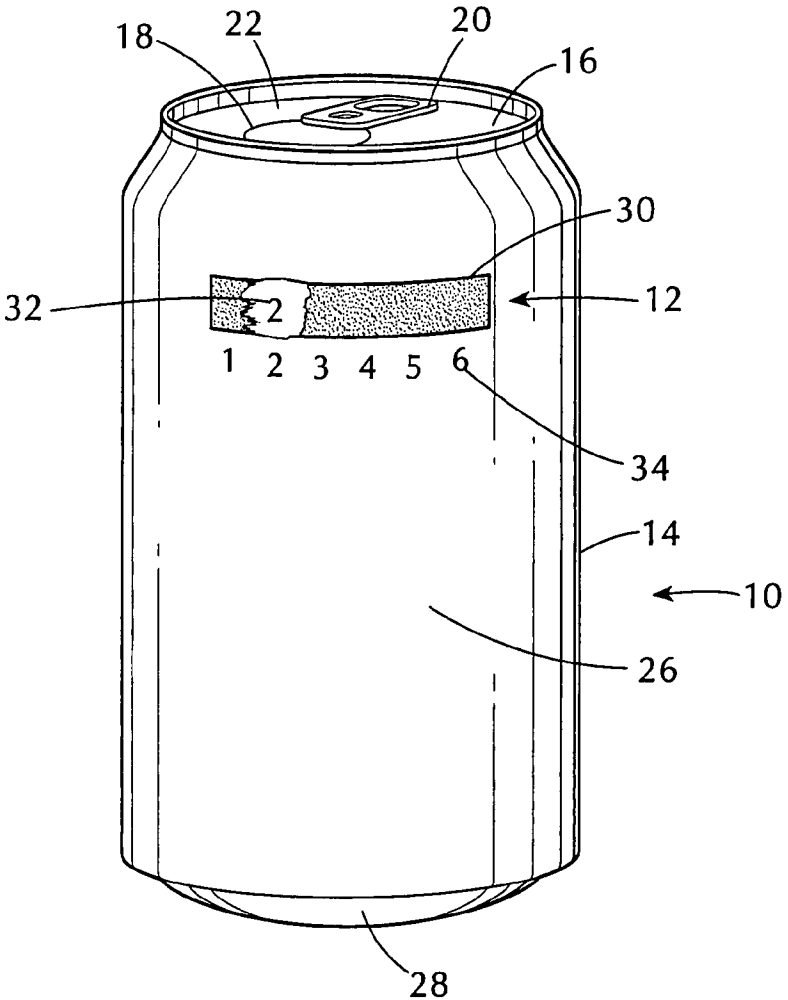
FIG. 2 is a perspective view of a container including the identification system according to the embodiment shown in FIG. 1 in which the opaque covering material has been removed to expose a printed identifying indicia.

While this invention is susceptible of embodiments in many different forms, this specification and the accompanying drawings disclose only one form as an example of the use of the invention. The invention is not intended to be limited to the embodiments so described, and the scope of the invention will be pointed out in the appended claims.

The identification system according to the present invention provides a means for distinguishing among individual containers of a consumer package of products. These individual containers are typically in the form of a set of containers each substantially visually identical in size and shape to one another and which may or may not contain identical contents. For example, the individual containers may be containers of a consumer pack of beverages packaged in sets of like containers such as bottles, cans or boxes. As is well-known in the art, the individual containers are typically removably secured to each other as an integrated consumer pack by means of a plastic wrap or a flexible plastic retainer. When packaged as a consumer pack without the benefit of the present invention, all of the containers are initially indistinguishable since generally identical trade dress, trademarks and other container information are displayed thereon.

In the drawings and in the corresponding description which follows, the identification system of the present invention will be described in detail with a particular application to beverage containers, such as beverage cans and disposable cups. It is understood by those of ordinary skill in the art, however, that the identification system of the present invention is suitable for use with other types of beverage containers, such as beverage bottles, boxes and the like. It is also understood that the identification system of the present invention is not limited to use in connection with beverage containers, but is also suitable for use in connection with containers containing other types of alimentary products, such as food products and certain types of medications in liquid or solid forms.

Figure 1:
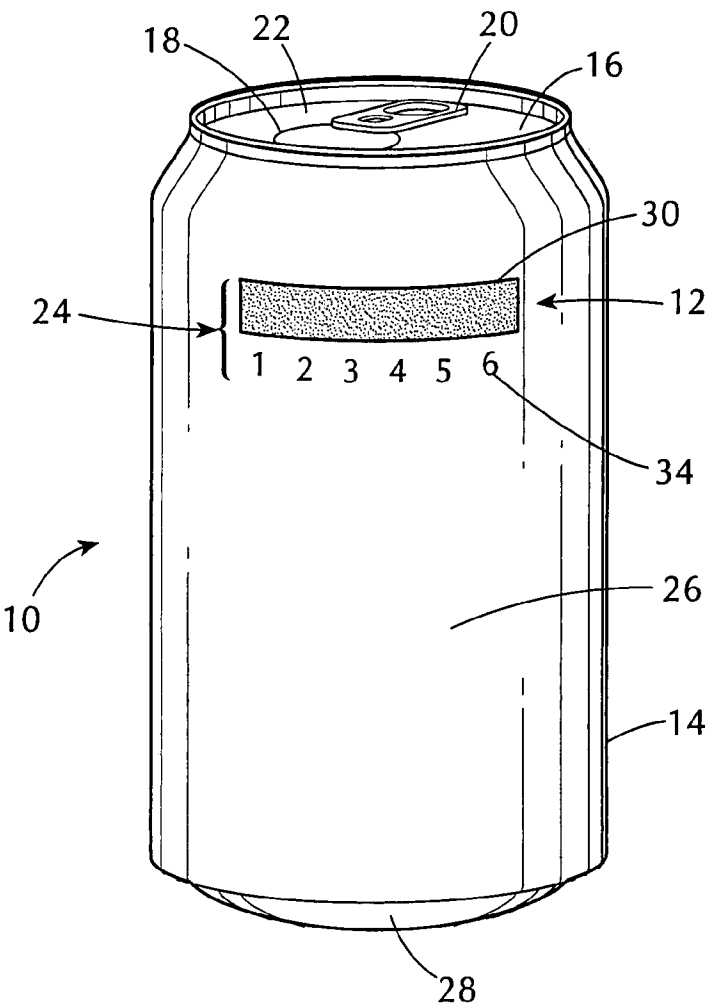
FIG. 1 is a perspective view of a container including an identification system according to an embodiment of the present invention.

Referring now to the drawings in detail, wherein like numerals are used to indicate like elements throughout, there is shown in FIGS. 1-11 embodiments of an identification system for individual containers according to the present invention. FIGS. 1-2 illustrate perspective views of a beverage container, generally designated at 10, including an identification system, generally designated at 12, in accordance with the present invention. The container 10 is in the form of a beverage can made of known materials such as aluminum or aluminum alloys. The beverage can 10 has a cup-shaped can body 14 and an end closure 16 secured on its top as by double seaming a peripheral edge portion of the end closure 16 on a top edge portion of the can body 14 as is well known in the industry. The end closure 16 has a pour opening defined therein by a score line 18 and a tab 20 which is adapted to be lifted to rupture the score line 18 around a removable panel 22 and depress the panel into the beverage can 10.

The identification system 12 comprises generally an identifier member 24 associated with each of the containers in the set for facilitating visual discrimination of each of the containers from the others of the set. In the embodiment shown in FIGS. 1-2, the identifier member 24 is provided on an exterior surface of the beverage can 10, such as a sidewall 26 of the can body 14. It is understood by those skilled in the art, however, that the identifier member 24 can be provided at a variety of other locations on the beverage can 10, such as on the end closure 16 or on a bottom wall 28.

As shown in FIG. 2, the identifier member 24 has first distinct and visibly different printed identifying indicia 32 positioned over a surface portion of the sidewall 26 of the beverage can 10 and an opaque covering material 30 covering the first printed identifying indicia 32. The opaque covering material 30 is removable to selectively expose a preselected one of the first printed identifying indicia 32 so that during consumption of the beverage in the beverage can 10, a user may readily distinguish his beverage can from the other beverage cans in the set by visual inspection of the exposed first printed identifying indicia 32. FIG. 1 shows the identifier member 24 with the opaque covering material 30 concealing the first printed identifying indicia, and FIG. 2 shows a portion of the opaque covering material 30 removed so that one of the first printed identifying indicia 32 is exposed and visible. In this embodiment, the first: printed identifying indicia 32 consists of numbers "1-6" of which only the number "2" has been randomly exposed by removing the opaque covering material 30.

The identifier member 24 also has second distinct and visibly different printed identifying indicia 34 associated with each of the beverage cans 10 in the set and each corresponding identically to a respective one of the first printed identifying indicia 32. Each of the second printed identifying indicia 34 is disposed over a surface portion of the sidewall 26 of the beverage can 10 different from the surface portion thereof on which the first printed identifying indicia 32 is disposed. Each of the second printed identifying indicia 34 is generally aligned with a corresponding identical one of the first printed identifying indicia 32. For example, as shown in FIG. 2, the second printed identifying indicia 34 consist of numbers "1-6" and the number "2" is aligned with, and corresponds identically to, the exposed number "2" of the first printed identifying indicia 32. Each the remaining numbers "1" and "3-6" of the second printed identifying indicia 34 is also aligned with, and corresponds to, a respective one of the numbers "1" and "3-6" of the first printed identifying indicia 32 which are not exposed in FIGS. 1-2.

The first and second printed identifying indicia 32, 34 are preferably printed on the exterior surface of the beverage can 10 by ink jet printing which is economical and produces a durable and easily readable print on beverage cans. The ink used for printing the first and second printed identifying indicia 32, 34 on the exterior surface of the beverage can 10 is preferably a water-resistant, non-toxic, and scratch-resistant ink which is generally known in the industry for printing trade dress, trademarks and other information on exterior surfaces of beverage cans. However, it is understood by those skilled in the art that other types of ink and printing processes are suitable for printing the first and second printed identifying indicia 32, 34 on the exterior surface of the beverage can 10 without departing from the spirit and scope of the invention.

The opaque covering material 30 is preferably in the form of a coating of scratch-off non-transparent material that covers or conceals the first printed identifying indicia 32 until the coating is scratched off to expose the first printed identifying indicia 32. The scratch-off coating is preferably a thin layer of pigmented paraffin or other kind of wax, plastic or other substance which is applied through a rolling, spraying or stamping process that is normally used to make scratch-off lottery-type game pieces. The scratch-off coating is preferably water-resistant and should be able to withstand condensation from the beverage can 10. The scratch-off coating remains intact on the exterior surface of the beverage can 10 following manufacture, transportation and retailing but should be of a consistency that allows the user to easily remove the coating from the beverage can by scratching it with a fingernail, coin, or other sharp or sturdy object. The scratch-off coating should be relatively flat and conform to the shape of the exterior surface of the beverage can 10.

During use of the foregoing embodiment of the identification system according to the present invention, a user of the beverage in one of the beverage cans 10 in a set or pack of the beverage cans 10 selects a preselected one of the second printed identifying indicia 34 from the identifier member 24 and scratches off the corresponding portion of the scratch-off coating directly above it to expose the corresponding identical first printed identifying indicia 32. Users of the beverage in the other beverage cans 10 in the pack will follow the same procedure but will expose instead one of the first printed identifying indicia 32 which does not correspond to the first printed identifying indicia selected and exposed by other users of the beverage cans 10 in the pack. Thus, by the identification system according to the present invention, the open individual beverage cans from the pack can be easily distinguished from one another and the users can visibly and quickly identify their opened beverage can from other opened beverage cans in the pack having the same general appearance. Thus the identification system of the present invention prevents the inadvertent drinking from the wrong beverage can, particularly where a number of individuals are using beverage cans having the same general appearance. This in turn protects the consumers of the beverages from the risk of exposure to any contagious medical condition that other similar consumers may have.

Figure 3:
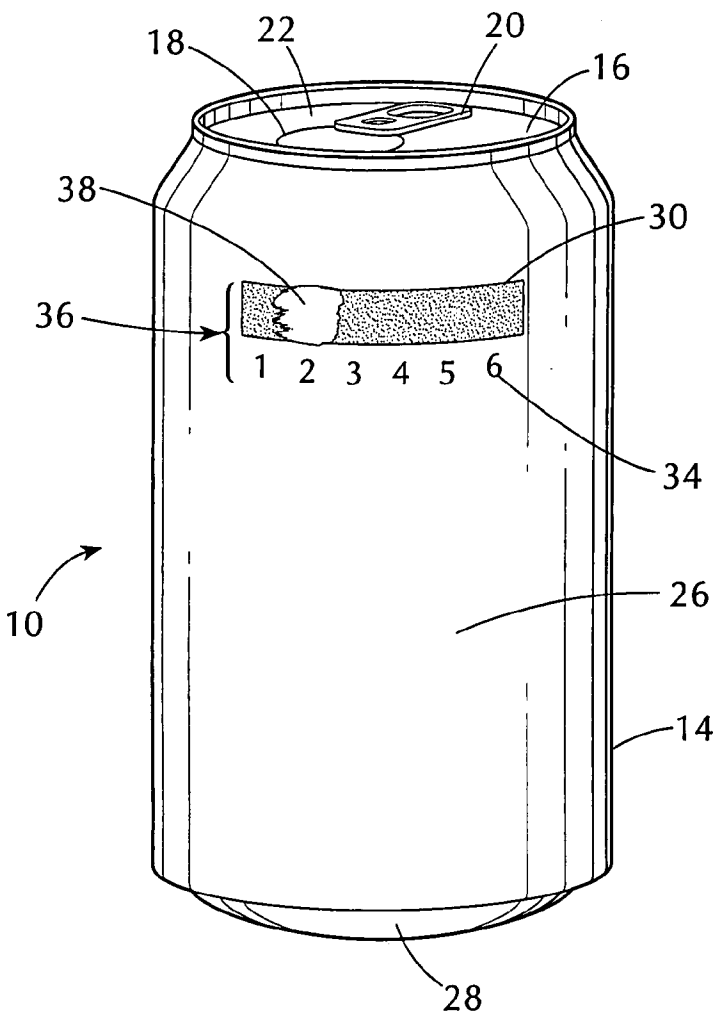
FIG. 3 is a perspective view of a container including an identification system according to another embodiment of the present invention.

FIG. 3 shows another embodiment of the identification system for individual containers according to the present invention. In this embodiment, an identifier member 36 of the identification system is identical to the embodiment described above for the identifier member 24 in FIGS. 1-2, except that the identifier member 36 does not have the first printed identifying indicia 32. More specifically, instead of concealing printed identifying indicia, the opaque covering material 30 conceals a preselected area of the exterior sidewall surface of the beverage can 10. Thus, during use, instead of being removed to expose an printed identifying indicia as with the embodiment of FIGS. 1-2, the portion of the opaque covering material 30 corresponding to and disposed directly above the preselected printed identifying indicia 34 is removed to expose a portion 38 of the preselected area of the exterior sidewall surface of the beverage can 10. The opaque covering material 30 preferably has a color, texture and/or design which contrasts with the color, texture and/or design of the exterior sidewall surface of the beverage can 10. Accordingly, the preselected area, including the exposed portion 38, preferably has the same color, texture and/or design as other portions of the exterior sidewall surface of the beverage can 10 in order to easily distinguish the exposed portion 38 from remaining portions of the opaque covering material 30. In this manner, the ease of visibility of the exposed portion 38 is due to, for example, the contrasting color and shade between the opaque covering material 30 and the color and shade of the exterior sidewall surface of the beverage can 10. Alternatively, the preselected area may be of a different quality, such as color, texture, and design than the rest of the exterior sidewall surface of the beverage can 10 and the opaque covering material 30. By the foregoing construction, visual inspection of the exposed portion 38 can readily identify the corresponding printed identifying indicia 34 and, therefore, the identity of the user of the beverage in the beverage can 10.

Figure 4:
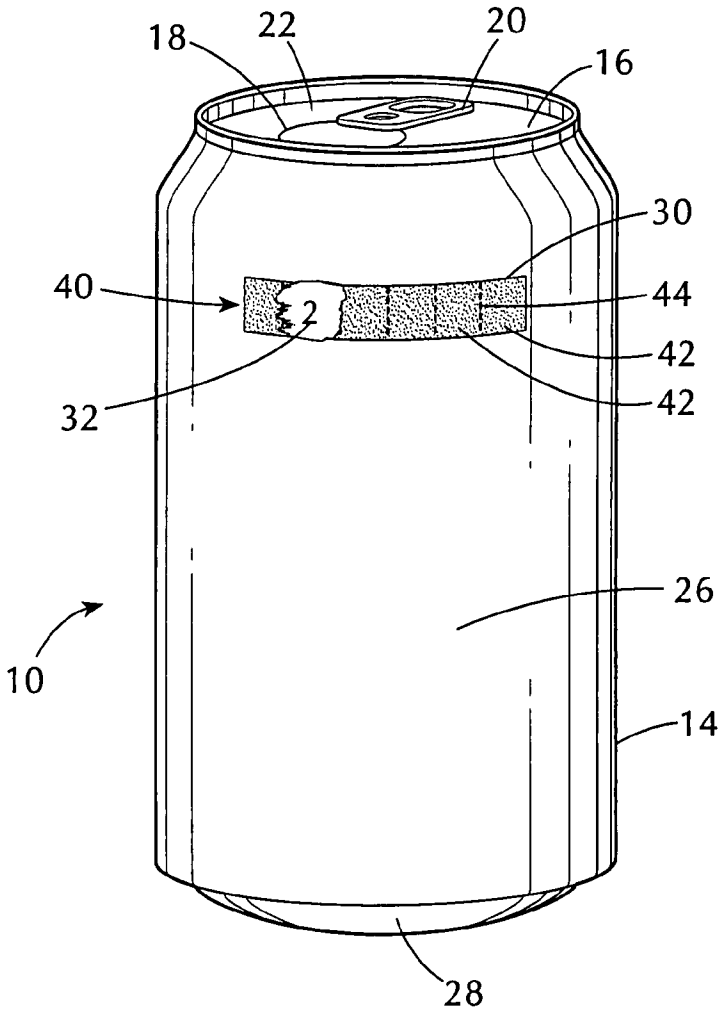
FIG. 4 is a perspective view of a container including an identification system according to another embodiment of the present invention.

FIG. 4 shows another embodiment of the identification system for individual containers according to the present invention. In this embodiment, an identifier member 40 of the identification system is identical to the embodiment of the identifier member 24 described above for in FIGS. 1-2, except that the identifier member 40 does not have the second printed identifying indicia 34. The only other difference from the identifier member 24 of FIGS. 1-2 is that in the identifier member 40, the opaque covering material 30 is applied over the printed identifying indicia 32 to form visible discrete areas 42 each corresponding to and covering a respective one of the printed identifying indicia 32. The visible discrete areas 42 correspond to portions of the opaque covering material 30 separated by visible demarcations such as represented by dashed lines 44. Each of the visible discrete areas 42 of the opaque covering material 30 is selectively removable to expose one of the printed identifying indicia 32. During use, the consumer will expose a preselected one of the printed identifying indicia 32 by removing the opaque covering material 30 from the corresponding visible discrete area 42. The visible discrete areas 42 of the opaque covering material 30 facilitates the selection of the preselected printed identifying indicia 32 since the identifier member 40 does not contain the second printed identifying indicia 34 as described above with respect to the embodiment of FIGS. 1-2. By this construction, during consumption of the beverage in the beverage container 10, the user may readily distinguish his beverage container from other similar containers in the pack by visual inspection of the removed discrete area of the opaque covering material and the corresponding exposed printed identifying indicia 32.

It will be understood by those of ordinary skill in the art that, as an alternative embodiment, the opaque covering material 30 of the identifier member 36 in FIG. 3 may have the same construction as the opaque covering material 30 of the identifier member 40 in FIG. 4. More specifically, in this alternative embodiment the opaque covering material 30 of the identifier member 36 is applied to cover the preselected area of the exterior sidewall surface of the beverage can 10 so as to form the visible discrete areas of the opaque covering material 30 each corresponding to and covering a corresponding one of subsequently exposed portions 38 and corresponding to a respective one of the printed identifying indicia 34.

In the embodiments of the identification system described above in connection with FIGS. 1-4, the identifier member in each of the beverage containers has been provided with six printed identifying indicia consisting of numbers "1-6", each of which is independently selected to identify a respective one of the beverage containers. It is understood by those of ordinary skill in the art, however, that the identification systems in these embodiments are not limited to the provision and selection of any particular number of printed identifying indicia. For example, each of the beverage containers may be provided with any desired number of printed identifying indicia to allow identification of all beverage containers in accordance with the specific number of beverage containers in the particular package. Furthermore, instead of selecting one of the printed identifying indicia, a user may select any combination of two or more of the printed identifying indicia to identify the beverage container in order to expand the possible number of combinations of printed identifying indicia to allow identification of all beverage containers in accordance with the specific number of beverage containers in the particular package. Additionally, when numerical printed identifying indicia are used, the printed identifying indicia for the respective beverage containers are ideally and preferably a sequential series (i.e., "1, 2, 3, etc.), without repetition. Alternatively, the numerical printed identifying indicia may be selected to be other than a sequential series.

Moreover, it is also understood by those of ordinary skill in the art that the identification systems are not limited to the provision of any particular type of printed identifying indicia. For example, instead of numbers, the printed identifying indicia used may be letters of the alphabet or any pictorial representations of recognizable objects or designs including but not limited to shapes with or without different colors, animals, cartoon characters, and representations of sports products. It is important, however, that the type or design of the printed identifying indicia associated with each beverage container is different from the others so that the beverage containers in a given set or package can be distinguished one from the other as set forth above.

Figure 5:
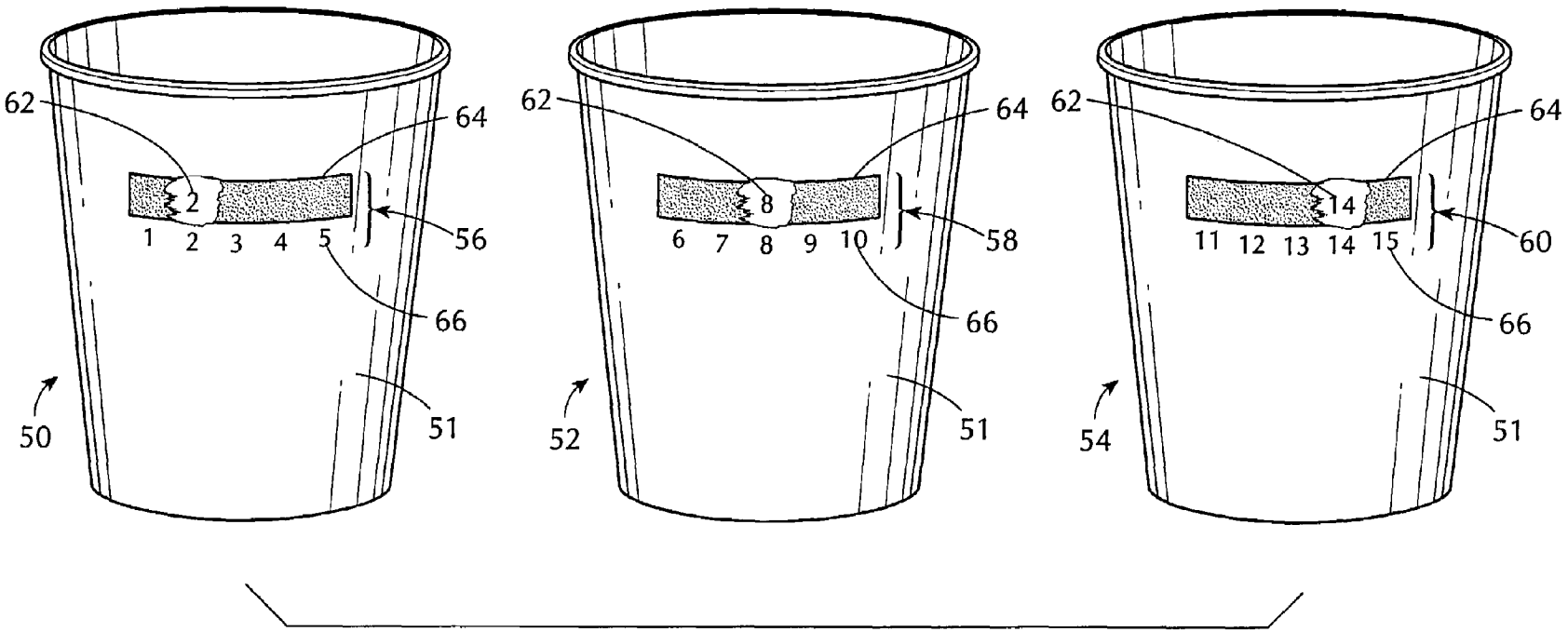
FIG. 5 is a perspective view showing containers embodying an identification system according to another embodiment of the present invention.

FIG. 5 shows another embodiment of the identification system for individual containers according to the present invention. In this embodiment, the identification system of the present invention is employed for individualizing a set of disposable containers, such as disposable drinking cups 50, 52 and 54. The set of disposable cups in this embodiment has three groups of cups each containing a preselected number of the cups 50, 52 and 54, respectively. The cups 50, 52, 54 within the three groups are all substantially visually identical in size and shape to each other. The preselected number of cups 50, 52, 54 for each of the groups is determined in accordance with the identifier member of the identification system selected as set forth below.

Each of the cups 50, 52, 54 in each of the three groups is provided with an identifier member for facilitating visual discrimination of each of the cups within any group from one another and from the cups of other groups. More specifically, each of the cups 50 has an identifier member 56, each of the cups 52 has an identifier member 58, and each of the cups 54 has an identifier member 60. In this embodiment, each of the identifier members 56, 58, 60 has the same construction as the identifier member 24 described above with reference to the embodiment of FIGS. 1-2. Each of the identifier members 56, 58, 60 has a first set of distinct and visibly different printed identifying indicia 62 positioned over a surface portion of an exterior sidewall 51 of the cups, an opaque covering material 64 covering the first printed identifying indicia 62, and a second set of distinct and visibly different printed identifying indicia 66 disposed over a surface portion of the sidewall 51 of the cups different from the surface portion thereof on which the first printed identifying indicia 62 is disposed. For each of the identifier members 56, 58, 60, each of the second printed identifying indicia 66 corresponds identically to, and is generally aligned with, a respective one of the first printed identifying indicia 62. However, the first and second printed identifying indicia 62, 66 of each of the identifier members 56, 58, 60 differ from the first and second printed identifying indicia of the other identifier members. More specifically, each the first and printed identifying indicia of the identifier member 56 consists of numbers "1-5", each the first and second printed identifying indicia of the identifier member 58 consists of numbers "6-10", and each the first and second printed identifying indicia of the identifier member 60 consists of numbers "11-15". With the foregoing selection of the first and second printed identifying indicia, each of the three groups of cups may contain, for example, five cups for a total of fifteen cups in the set. That is, five of the cups contain the identifier member 56, five of the cups contain the identifier member 58, and five of the cups contain the identifier member 60.

The specific structure of the opaque covering material 64, the method for applying the opaque covering material on the exterior surfaces of the cups, and the material and method for providing the first and second printed identifying indicia on the exterior surfaces of the cups are the same as those for the identification system described above for the embodiment of FIGS. 1-2. Likewise, use of the identification system in the embodiment of FIG. 5 is the same as described above for the embodiment of FIGS. 1-2. In this regard, after obtaining a cup from one of the groups in the set, the user selects one of the second printed identifying indicia 66 and scratches off the corresponding portion of the scratch-off coating directly above it to expose the corresponding identical first printed identifying indicia 62. Other users will follow the same procedure with respect to cups from the same group or other groups in the set but will expose instead one of the first printed identifying indicia 66 which does not correspond to the first printed identifying indicia 66 exposed by other users in connection with their cups. Thus, by the identification system of the invention shown in FIG. 5, individual disposable cups which have the same general appearance and which are being used by different people can be easily distinguished from one another and the users can visibly and quickly identify their cups from other cups in the set being used.

The specific embodiment of the identification system shown in FIG. 5 has been described as being adapted for use by fifteen users in view of the selected number of first and second printed identifying indicia and the selection of three groups each containing five cups. However, it is understood by those of ordinary skill in the art that this embodiment of the identification system is not limited to use by any number of users. For example, the selection of the numbers "1-5", "6-10" and "11-15" for the first and second printed identifying indicia 62, 66 and the selection of three groups of cups each containing five cups is merely exemplary of the number and type of printed identifying indicia which may be applied to the cups. Any number and type of first and second printed identifying indicia may be associated with the cups as set forth above for the embodiments of FIGS. 1-4 so long as the number and type of first and second printed identifying indicia are the same for the cups within each group and are different from one group to another.

Moreover, while the cups in the embodiment of FIG. 5 are associated with an identification system as described above for the embodiment of FIGS. 1-2, it is understood by those of ordinary skill in the art that any of the identification systems described above for the embodiments of FIGS. 3 and 4 may also be associated with each of the cups in FIG. 5.

Figure 6:
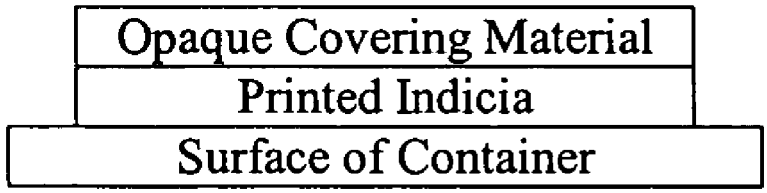
FIG. 6 is a diagram of the composite structure of an embodiment of the identifier member in the identification system according to the present invention.

FIGS. 6-9 show embodiments of the composite structure of the identifier member in the identification system according to the present invention. FIG. 6 is a representation of the composite structure for each of the identifier members described above in connection with FIGS. 1-2, 4 and 5. With respect to the embodiment of FIGS. 1-2 and 5, FIG. 6 is a representation of a composite structure 70 of part of the identifier member in which the opaque covering material covers the first printed identifying indicia printed on the surface of the beverage container or cup. The second printed identifying indicia is present in the identifier member of FIGS. 1-2 and 5 but has been omitted from this representation. The composite structure 70 depicts all three components of the identifier member of FIG. 4 which does not contain second printed identifying indicia as set forth above.

Figure 8:
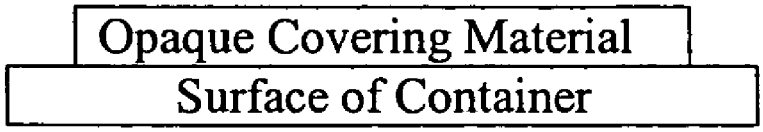
FIG. 8 is a diagram of the composite structure of another embodiment of the identifier member in the identification system according to the present invention.

FIG. 8 is a representation of a composite structure 74 for the identifier member described above in connection with FIG. 3. The composite structure 74 has the opaque covering material applied directly on the surface of the container with no printed identifying indicia disposed therebetween. The printed identifying indicia 34 in FIG. 3 which is disposed on the exterior surface portion of the beverage container different from the exterior surface portion on which the opaque covering material is disposed has been omitted from this representation.

Figure 7:
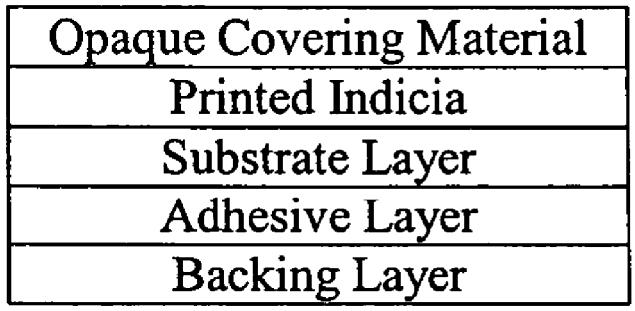
FIG. 7 is a diagram of the composite structure of another embodiment of the identifier member in the identification system according to the present invention.
Figure 9:
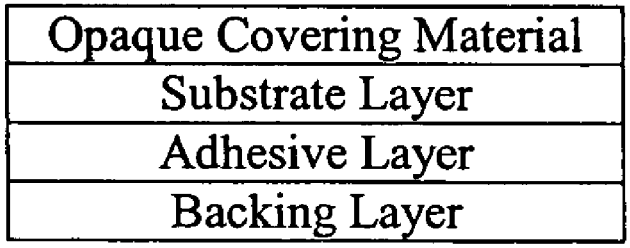
FIG. 9 is a diagram of the composite structure of another embodiment of the identifier member in the identification system according to the present invention.

The opaque covering material and the printed identifying indicia of the identifier members represented by the composite structures described above with reference to FIGS. 6 and 8 are each applied on the exterior surface of the beverage containers or cups using conventional devices and methods as described above. FIGS. 7 and 9, on the other hand, are representations of composite structures of the identifier member in the form of labels which are applied to the exterior surfaces of the beverage containers and cups.

FIG. 7 illustrates an embodiment of the layered construction of a label 72 for use, for example, as the identifier member 40 in the embodiment of the identification system described above with reference to FIG. 4. The label 72 has a paper or plastic substrate layer having a first main surface on which the printed identifying indicia 32 is printed. The layer of opaque covering material is disposed over the first main surface of the substrate layer so as to completely cover and conceal the printed identifying indicia. An adhesive layer is disposed on a second main surface of the substrate layer opposite the first main surface thereof. The adhesive layer is covered with a paper or plastic backing layer which is coated as is normally used on stickers so as to release easily from the adhesive layer so that it may be removed to expose the adhesive layer prior to use of the label 72. The substrate layer can be an ordinary label stock which is purchased with the adhesive layer and the backing layer or may be bonded with adhesive or other process to the exterior surface of the beverage container during application of the label 72. The label 72 may be manufactured on a label stock which utilizes pressure sensitive adhesive so that the label can be sold by itself and applied by the manufacturer or consumer to the exterior surface of the beverage container. Alternatively, the adhesive may be solvent activated for use by a manufacturer or consumer for applying the label 72 as set forth above.

The label 72 has been described above with a particular application to the embodiment of the identification system described above with reference to FIG. 4. It is understood by those of ordinary skill in the art, however, that the label 72 may also be used in connection with the embodiment of the identification system described above with reference to FIGS. 1-2 and 5.

FIG. 9 illustrates an embodiment of the layered construction of a label 76 for use, for example, as the identifier member 36 in the embodiment of the identification system described above with reference to FIG. 3. The label 76 of FIG. 9 has the same components as the label 72 described above with reference to FIG. 7 except that the label 76 does not have the printed identifying indicia on the surface of the substrate layer in accordance with the embodiment of FIG. 3. Thus, instead of concealing printed identifying indicia, the opaque covering material conceals the first main surface of the substrate layer which corresponds to the preselected area of the exterior sidewall surface of the beverage can 10 in the embodiment of FIG. 3. The label 76 is applied on the exterior surface of the beverage container 10 as set forth above for the label 72.

When the label 76 is used to construct the identifier member 36 in FIG. 3, the printed identifying indicia 3.4 may be printed directly on the exterior surface of the beverage container as described above so that the printed identifying indicia 34 is aligned with the main surface of the substrate layer of the label 76 when the label 76 is applied on the exterior surface of the beverage container. Alternatively, the printed identifying indicia 34 may also be in the form of a label having a substrate layer with a first main surface on which the printed identifying indicia is printed and a second main surface having an adhesive coating for adhering the substrate layer to the exterior surface of the beverage container.

The opaque covering material of the label 76 preferably has a color, texture and/or design which contrasts with the color, texture and/or design of the exterior sidewall surface of the beverage can 10. Accordingly, the first main surface of the substrate layer preferably has the same color, texture and/or design as the exterior sidewall surface of the beverage can 10 in order to visually distinguish the portions of the first main surface of the substrate layer from the portions of the opaque covering material. In this manner, the ease of visibility of exposed portions of the first main surface of the substrate layer is due to, for example, the contrasting color and shade between the opaque covering material and the color and shade of the exterior sidewall surface of the beverage can 10. Alternatively, the first main surface of the substrate layer may be of a different quality, such as color, texture, and design than the rest of the exterior sidewall surface of the beverage can 10 and the opaque covering material 30.

By the foregoing construction, visual inspection of exposed portions of the main surface of the substrate layer can readily identify the corresponding printed identifying indicia 34 and, therefore, the identity of the consumer of the beverage in the beverage can 10. The label 72 has been described above with a particular application to the embodiment of the identification system described above with reference to FIG. 4. It is understood by those of ordinary skill in the art, however, that the label 72 may also be readily modified for use in connection with the embodiment of the identification system described above with reference to FIGS. 1-2 and 5 without departing from the spirit and scope of the present invention.

Figure 11:
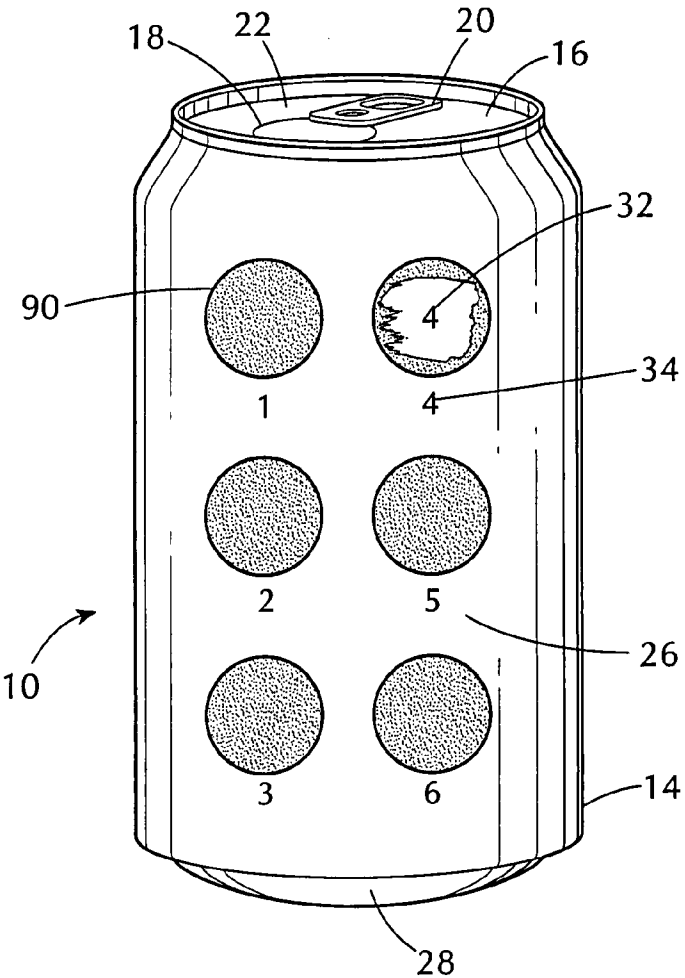
FIG. 11 is a perspective view of a container including an identification system according to another embodiment of the present invention.
Figure 10:
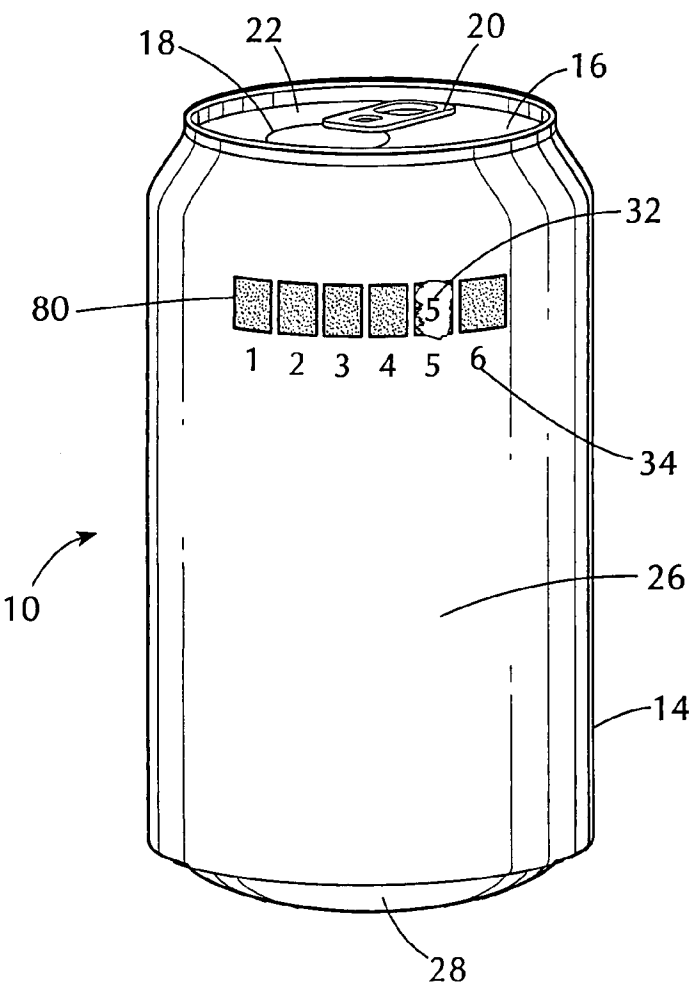
FIG. 10 is a perspective view of a container including an identification system according to another embodiment of the present invention.

In the foregoing embodiments of the identification systems described above with reference to FIGS. 1-2, the opaque covering material of the identifier member is a single, continuous layer of scratch-off material. FIGS. 10 and 11 show modified versions of the identifier member in which the layer of scratch-off material is separated into different portions 80, 90, respectively, disposed in spaced-apart relation from one another and arranged in a prescribed pattern along the exterior sidewall surface of the beverage container 10. In FIGS. 10 and 11, each of the first printed identifying indicia 32 is covered by a respective one of the portions 80 or 90, and each of the second printed identifying indicia is disposed directly under a respective one of the portions 80 or 90.

In the embodiment of FIG. 10, the portions 80 of the scratch-off material and the corresponding first and second printed identifying indicia 32, 34 are disposed along a single row. In the embodiment of FIG. 11, the portions 90 of the scratch-off material and the corresponding first and second printed identifying indicia 32, 34 are arranged in a pattern along the exterior surface of the beverage container 10 to form two columns and three rows. However, it is understood by those of ordinary skill in the art that the arrangement of the portions 80, 90 of the scratch-off material and the first and second printed identifying indicia 32, 34 on the exterior surface of the beverage container is not limited to the specific pattern arrangements shown in FIGS. 10 and 11 or any other pattern arrangement. Any type of pattern arrangement is suitable so long as when the identification system is in use, the portions 80, 90 of the scratch-off material and the corresponding printed identifying indicia 32, 34 provide adequate identification of the beverage containers as set forth above. It is also understood that the portions 80, 90 of the scratch-off material are not limited to the generally rectangular and circular shapes shown in FIGS. 10 and 11. Other shapes, including square, triangular and octagonal shapes, and configurations in the form of various symbols, pictures and characters are suitable for the portions 80, 90 of the scratch-off material.

While the foregoing modifications of the identification system shown in FIGS. 10-11 have been described with a particular application to the embodiment of FIGS. 1-2, it is understood that such modifications are also suitable for each of the embodiments of FIGS. 3-5 and the labels of FIGS. 7 and 9. For example, when modified in accordance with the embodiment of FIG. 10 or 11, the first printed identifying indicia will be omitted from the embodiment of FIG. 3 and the second printed identifying indicia will be omitted from the embodiment of FIG. 4 as set forth above.

From the foregoing description, it can be seen that the present invention comprises an improved identification system for individual containers. It will be appreciated by those skilled in the art that obvious changes can be made to the embodiments described in the foregoing description without departing from the broad inventive concept thereof. For example, while in the embodiments of the identification system shown in FIGS. 1-5, 10 and 11 the identifier member is provided on an exterior sidewall surface portion(s) of the container, it is understood that the identifier member can be provided at any of a variety of other exterior surface portion(s) of the container, including exterior top or bottom surface portion(s) of the container.

Furthermore, the identification systems of the present invention are not limited to the provision and selection of any particular number of printed identifying indicia. For example, each of the beverage containers may be provided with any number of printed identifying indicia to allow identification of all beverage containers in accordance with the specific number of beverage containers in the particular package. Likewise, instead of selecting one of the printed identifying indicia, a user may select any combination of two or more of the printed identifying indicia to identify the beverage container in order to expand the possible number of combinations of printed identifying indicia to allow identification of all beverage containers in accordance with the specific number of beverage containers in the particular set or package.

Moreover, it is understood by those of ordinary skill in the art that the identification systems of the present invention are not limited to the provision of any particular type of printed identifying indicia. For example, instead of numbers, the printed identifying indicia used may be letters of the alphabet or any pictorial representations of recognizable objects or designs including but not limited to shapes with or without different colors, animals, cartoon characters, and sports products. It is important, however, that the type or design of the printed identifying indicia associated with each beverage container is different from the others so that the beverage containers in a given set or package can be distinguished one from the other as set forth above.

Moreover, the identification system of the present invention is not limited to use with containers that are substantially visually identical in size and/or shape as described above. The identification system could, if desired, be also used in conjunction with containers that have different sizes and/or shapes. For example, while during a function a host may use cups or glasses of different sizes and/or shapes, it is possible that a user cannot remember which cup or glass he has. With the identification system according to the present invention, the user may readily identify his cup or glass by just remembering his selected printed identifying indicia on his cup or glass. Thus, it is understood that the identification system of the present invention is adapted for use with containers that are either substantially visually identical or different in size and/or shape.

It will be appreciated from the foregoing description that the present invention provides an identification system for distinguishing among individual containers of a consumer package of products, such as food and beverage products, which are visually substantially identical in size and shape to one another. The identification system of the present invention prevents the inadvertent eating or drinking from the wrong container and, therefore, protects the user of the products from the risk of exposure to any contagious medical condition that other consumers may have. The identification system of the present invention is simple, easy to use, cost effective, and does not distract from the manufacturer's or distributor's trade dress, trademark or container labeling information.

It is understood from the foregoing that this invention is not limited to the particular embodiments disclosed, but is intended to cover all obvious modifications thereof which are within the scope and the spirit of the invention as defined by the appended claims.

What is claimed is:

1. In combination with a set of individual containers, an identification system for distinguishing among the individual containers, the identification system comprising: an identifier member associated with each of the containers in the set for facilitating visual discrimination of each of the containers from the others of the set, the identifier member of each container in the set comprising a plurality of distinct and visibly different printed identifying indicia positioned over a surface portion of the container and an opaque covering material covering the printed identifying indicia, the opaque covering material being removable to selectively expose a preselected one of the printed identifying indicia so that during consumption of the contents of the container a user may readily distinguish his container from the other containers in the set by visual inspection of the exposed printed identifying indicia; wherein the plurality of distinct and visibly different printed identifying indicia of the identifier member comprises a plurality of first distinct and visibly different printed identifying indicia, and the surface portion of the container comprises a first surface portion of the container; and wherein the identifier member further comprises a plurality of second distinct and visibly different printed identifying indicia associated with each of the containers in the set and each corresponding identically to a respective one of the first printed identifying indicia, each of the second printed identifying indicia being disposed over a second surface portion of the container different from the first surface portion and being generally aligned with the corresponding identical one of the first printed identifying indicia.

2. A combination according to claim 1; wherein the opaque covering material comprises a coating of scratch-off non-transparent material that conceals the printed identifying indicia until the coating is scratched off to expose the preselected printed identifying indicia.

3. A combination according to claim 1; wherein the content in each of the containers in the set comprises an alimentary product.

4. A combination according to claim 3; wherein the alimentary product comprises a beverage.

5. A combination according to claim 3; wherein the alimentary product comprises a food product.

6. A combination according to claim 1; wherein each of the containers in the set comprises a can containing a beverage and having a sidewall; and wherein the identifier member is disposed on the sidewall of the can.

7. A combination according to claim 6; wherein the opaque covering material comprises a coating of scratch-off non-transparent material that conceals the printed identifying indicia until the coating is scratched off to expose the preselected printed identifying indicia.

8. In combination with a set of individual containers, an identification system for distinguishing among the individual containers, the identification system comprising: an identifier member associated with each of the containers in the set for facilitating visual discrimination of each of the containers from the others of the set, the identifier member of each container in the set comprising a plurality of distinct and visibly different printed identifying indicia positioned over a surface portion of the container and an opaque covering material covering the printed identifying indicia, the opaque covering material being removable to selectively expose a preselected one of the printed identifying indicia so that during consumption of the contents of the container a user may readily distinguish his container from the other containers in the set by visual inspection of the exposed printed identifying indicia; wherein the identifier member further comprises a substrate layer having a first main surface on which the printed identifying indicia is printed and over which the opaque covering material is disposed to cover the printed identifying indicia, and an adhesive layer material disposed on a second main surface of the substrate layer opposite the first main surface for adhering the substrate layer to the surface portion of the container.

9. In combination with a set of individual containers, an identification system for distinguishing among the individual containers, the identification system comprising: an identifier member associated with each of the containers in the set for facilitating visual discrimination of each of the containers from the others of the set, the identifier member of each container in the set comprising a plurality of distinct and visibly different printed identifying indicia positioned over a first surface portion of the container and an opaque covering material disposed over a second surface portion of the container different from the first surface portion thereof and having a preselected color, the opaque covering material having a color which contrasts with the preselected color of the second surf ace portion of the container and having a plurality of visible discrete areas each corresponding to a respective one of the printed identifying indicia, each of the visible discrete areas of the opaque covering material being selectively removable to expose the preselected color of the second surface portion of the container so that during consumption of the contents of the container a user may readily distinguish his container from the other containers in the set by visual inspection of the exposed preselected color of the second surface of the container corresponding to the removed discrete area of the opaque covering material and by visual inspection of the printed identifying indicia corresponding to the removed discrete area of the opaque covering material.

10. A combination according to claim 9; wherein the opaque covering material comprises a coating of scratch-off non-transparent material that conceals the preselected color of the second surface portion of the container until the coating of the selected visible discrete area is scratched of f to expose the preselected color of the second surface portion of the container.

11. A combination according to claim 9; wherein the content in each of the containers in the set comprises an alimentary product.

12. A combination according to claim 11; wherein the alimentary product comprises a beverage.

13. A combination according to claim 11; wherein the alimentary product comprises a food product.

14. A combination, according to claim 9; wherein each of the containers in the set comprises a can containing a beverage and having a sidewall; and wherein the identifier member is disposed on the sidewall of the can.

15. A combination according to claim 14; wherein the opaque covering material comprises a coating of scratch-off non-transparent material that conceals the preselected color of the second surface portion of the container until the coating of the selected visible discrete area is scratched off to expose the preselected color of the second surface portion of the container.

16. A combination according to claim 9; wherein the identifier member further comprises a substrate layer having a first main surface on which the opaque covering material is disposed, and an adhesive layer disposed on a second main surface of the substrate layer opposite the first main surface for adhering the substrate layer to the second surface portion of the container.

17. A combination according to claim 16; wherein the identifier member further comprises a removable backing layer disposed over the adhesive layer for protecting the adhesive layer prior to adhering the substrate layer to the second surface portion of the container.

18. A combination according to claim 16; wherein the opaque covering material comprises a coating of scratch-off non-transparent material that conceals the preselected color of the second surface portion of the container until the coating of the selected visible discrete area is scratched off to expose the preselected color of the second surface portion of the container.

19. In combination with a plurality of groups of separate containers, an identification system for distinguishing among the containers within all of the groups, the identification system comprising: an identifier member associated with each of the containers in each of The groups for facilitating visual discrimination of each of the containers within any group from one another and from the containers of other groups, the identifier member associated with each of the containers within all of the groups comprising a set of distinct and visibly different printed identifying indicia positioned over a surface portion of the container and an opaque covering material covering the set of printed identifying indicia, all of the sets of printed identifying indicia within any group of containers being substantially visually identical to one another, the sets of printed identifying indicia of each group of containers being visually distinct from the sets of printed identifying indicia of other groups of containers, and the opaque covering material of the identifier member associated with each of the containers of the sets within all of the groups being removable to selectively expose a preselected one of the printed identifying indicia so that during consumption of the contents of the container a user may readily distinguish his container from The other containers within any group and from the containers of other groups by visual inspection of the exposed printed identifying indicia; wherein the set of distinct and visibly different printed identifying indicia of the identifier member for the container in each group comprises a set of first distinct and visibly different printed identifying indicia and the surface portion of the container comprises a first surface portion of the container; and wherein the identifier member further comprises a set of second distinct and visibly different printed identifying indicia associated with each of the containers in each group and each corresponding identically to a respective one of the first printed identifying indicia, each of the second printed identifying indicia being disposed over a second surface portion of the container different from the first surface portion and being generally aligned with the corresponding identical one of the first printed identifying indicia, all of the sets of second printed identifying indicia within any group of containers being substantially visually identical to one another, and the sets of second printed identifying indicia of each group of containers being visually distinct from the sets of second printed identifying indicia of other groups of containers.

20. A combination according to claim 19; wherein the opaque covering material comprises a coating of scratch-off non-transparent material that conceals the printed identifying indicia until the coating is scratched of f to expose the preselected printed identifying indicia.

21. A combination according to claim 19; wherein each of the containers of each group has a sidewall; and wherein the identifier member is disposed on the sidewall of the container.

22. In combination with a plurality of groups of separate containers, an identification system for distinguishing among the containers within all of the groups, the identification system comprising: an identifier member associated with each of the containers in each of the groups for facilitating visual discrimination of each of the containers within any group from one another and from the containers of other groups, the identifier member associated with each of the containers within all of the groups comprising a set of distinct and visibly different printed identifying indicia positioned over a surface portion of the container and an opaque covering material covering the set of printed identifying indicia, all of the sets of printed identifying indicia within any group of containers being substantially visually identical to one another, the sets of printed identifying indicia of each group of containers being visually distinct from the sets of printed identifying indicia of other groups of containers, and the opaque covering material of the identifier member associated with each of the containers of the sets within all of the groups being removable to selectively expose a preselected one of the printed identifying indicia so that during consumption of the contents of the container a user may readily distinguish his container from the other containers within any group and from the containers of other groups by visual inspection of the exposed printed identifying indicia; wherein the identifier member for the container in each group further comprises a substrate layer having a first main surface on which the printed identifying indicia is printed and over which the opaque covering material is disposed to cover the printed identifying indicia, and an adhesive layer disposed on a second main surface of the substrate layer opposite the first main surface for adhering the substrate layer to the surface portion of the container.

23. A combination according to claim 22; wherein the identifier member f or the container in each group further comprises a removable backing layer disposed over the adhesive layer for protecting the adhesive layer prior to adhering the substrate layer to the surface portion of the container.

24. A combination according to claim 23; wherein the opaque covering material comprises a coating of scratch-off non-transparent material that conceals the printed identifying indicia until the coating is scratched off to expose the preselected printed identifying indicia.

25. A combination according to claim 1; wherein the opaque covering material of the identifier member has a plurality of visible discrete areas each covering a respective one of the printed identifying indicia.

26. A combination according to claim 25; wherein the opaque covering material comprises a coating of scratch-off non-transparent material that conceals the printed identifying indicia until the coating is scratched off to expose the preselected printed identifying indicia.

27. A combination according to claim 8; wherein the identifier member further comprises a removable backing layer disposed over the adhesive layer for protecting the adhesive layer prior to adhering the substrate layer to the surface portion of the container.

28. A combination according to claim 19; wherein the opaque covering material of the identifier member for the container in each group has a plurality of visible discrete areas each covering a respective one of the printed identifying indicia.

29. A combination according to claim 28; wherein the opaque covering material comprises a coating of scratch-off non-transparent material that conceals the printed identifying indicia until the coating is scratched off to expose the preselected printed identifying indicia.

* * * * *